US009011156B2

(12) United States Patent
Hallmark

(10) Patent No.: US 9,011,156 B2
(45) Date of Patent: Apr. 21, 2015

(54) MOBILE TRAINING DEVICE

(71) Applicant: TAMH Enterprises Ltd., Gonzales, TX (US)

(72) Inventor: Timothy M. Hallmark, Gonzalez, TX (US)

(73) Assignee: TAMH Enterprises Ltd., Marble Falls, TX (US)

( * ) Notice: Subject to any disclaimer, the term of this patent is extended or adjusted under 35 U.S.C. 154(b) by 0 days.

(21) Appl. No.: 13/822,252

(22) PCT Filed: Jan. 16, 2013

(86) PCT No.: PCT/US2013/021697

§ 371 (c)(1),
(2) Date: Mar. 11, 2013

(87) PCT Pub. No.: WO2014/112991

PCT Pub. Date: Jul. 24, 2014

(65) Prior Publication Data

US 2014/0200122 A1 Jul. 17, 2014

(51) Int. Cl.
*A63B 69/00* (2006.01)

(52) U.S. Cl.
CPC ..... *A63B 69/0002* (2013.01)

(58) Field of Classification Search
CPC ..... A63B 69/0057; A63B 69/3608; A63B 2069/0008; A63B 2069/0062
USPC ..... 434/247, 252; 473/212, 215, 216, 451, 473/453; 482/91, 121, 122, 124
See application file for complete search history.

(56) References Cited

U.S. PATENT DOCUMENTS

| | | | | |
|---|---|---|---|---|
| 1,703,375 | A | 2/1929 | Volk | |
| 4,073,490 | A | 2/1978 | Feather | |
| 4,593,909 | A * | 6/1986 | Anselmo et al. | 473/216 |
| 4,968,028 | A * | 11/1990 | Wehrell | 482/124 |
| 5,586,962 | A | 12/1996 | Hallmark | |
| 5,803,822 | A | 9/1998 | Pursell | |
| 6,120,418 | A * | 9/2000 | Plough | 482/69 |
| 6,554,747 | B1 * | 4/2003 | Rempe | 482/38 |
| 6,612,845 | B1 * | 9/2003 | Macri et al. | 434/247 |
| 7,314,437 | B2 * | 1/2008 | Frappier | 482/124 |
| 7,438,653 | B2 | 10/2008 | Anderson | |
| 7,625,320 | B2 | 12/2009 | Wehrell | |
| 7,632,192 | B2 | 12/2009 | Begert | |
| 7,758,436 | B2 | 7/2010 | Reynolds | |
| 7,775,914 | B1 | 8/2010 | Greene | |
| 7,874,970 | B2 * | 1/2011 | Glisan | 482/124 |
| 7,887,463 | B2 | 2/2011 | Neuberg | |
| 8,100,815 | B2 * | 1/2012 | Balaker et al. | 482/70 |
| 8,162,807 | B1 | 4/2012 | Webber | |
| 8,187,153 | B2 | 5/2012 | Douglas | |
| 8,210,963 | B2 | 7/2012 | Papa | |
| 8,512,171 | B1 * | 8/2013 | Minotti | 473/451 |
| 8,568,253 | B2 * | 10/2013 | Shoaff | 473/409 |
| 8,784,230 | B1 * | 7/2014 | Mitchell | 473/271 |
| 8,840,075 | B2 * | 9/2014 | Dalebout et al. | 248/214 |

(Continued)

FOREIGN PATENT DOCUMENTS

WO PCT/US2013/021697 1/2013

*Primary Examiner* — Kurt Fernstrom
(74) *Attorney, Agent, or Firm* — Boulware & Valoir

(57) ABSTRACT

The present invention relates to a mobile training device having bi-directional, variable resistive forces for training a baseball swing and other sports involving weight transfer and hip rotation.

12 Claims, 4 Drawing Sheets

(56) References Cited

U.S. PATENT DOCUMENTS

| | | | | |
|---|---|---|---|---|
| 8,852,014 | B1 * | 10/2014 | Hoang | 473/208 |
| 2006/0148597 | A1 | 7/2006 | Pope | |
| 2006/0199706 | A1 | 9/2006 | Wehrell | |
| 2008/0287269 | A1 | 11/2008 | Humble | |
| 2012/0302406 | A1 | 11/2012 | Hinds | |

* cited by examiner

MOBILE TRAINING DEVICE

PRIOR RELATED APPLICATIONS

This invention claims priority to PCT/US13/21697 entitled "MOBILE TRAINING DEVICE" which was filed on Jan. 16, 2013. The patent application is incorporated by reference in its entirety.

FEDERALLY SPONSORED RESEARCH STATEMENT

Not applicable.

FIELD OF THE INVENTION

The invention relates to a training device. More particularly, the invention relates to an training device that can provide resistance simultaneously on two different axes with easy installation, stable during use and the ease of varying resistance.

BACKGROUND OF THE INVENTION

In certain sports, the transfer of body weight is considered the core of training. For example, in baseball the swing movement, the weight is first transferred to the back leg and then moved forward to generate energy. At the same time the back ankle starts rotation along with the back knee and the hip, which in turn bring the upper body, shoulder and arm to also rotate around the center of the body. In this process, the upward strength generated from the back leg (vertical) and the rotational strength of the hip (horizontal) are considered the key to a powerful swing.

The same is true for tennis and golf, where strength of the lower body generates the power for the swing action. U.S. Pat. No. 8,210,963 provides a device for improving golf swing by measuring the shift of golfer's body weight during a golf swing and comparing that to a technically sound swing. However, such device does not train or improve the user's lower body strength or rotational strength.

U.S. Pat. No. 8,187,153 provides an exercising machine for exercising a user's torso, arm, leg with computer-controlled resistance actuator. However, such device is complicated in structure, thus costly, and not easy to setup and use in a field training, such as a batting cage practice.

U.S. Pat. No. 8,162,807 describes a typical training device where weight is added to different part of the training device so as to work a particular part of the body. However, such device trainings the body only along one axis, and it is of no practical use in a field training.

U.S. Pat. No. 7,887,463 describes another typical leg training device that includes ski trainers, striders, steppers, elliptical trainers and exercise bikes. In this type of device the user steps on a carrier for each foot and exercises the leg by striding against resistance. However, this type of device does not work on the torso strength, especially on the rotation strength.

U.S. Pat. No. 7,775,914 only addresses the positioning of a baseball player's feet when swinging the bat. U.S. Pat. No. 6,773,366 only addresses the upper body training, especially the relative position of both arms during a swing.

U.S. Pat. No. 7,758,436 describes a swinging and hitting training aid for batters and golfers. It is a resistance-type indicator intended for a coach to determine whether the batter or golfer performs a proper swing. Little, if any, muscle strength is improved using this device.

U.S. Pat. No. 7,632,192 provides a multi-sport training device for improving hitting skills. However, insufficient resistance could be provided by the device, and a customized bat/club/racket must be provided in order to work with such device, making it impractical.

U.S. Pat. No. 7,625,320 provides a resistance swing training device that targets the hip rotation. However, that device has a large footprint and complicated structure, which is not easy to set up for field practice. Additionally, that device only provides resistance on the horizontal plane for rotation, without simultaneously addressing the issue of improving the vertical strength from the leg.

U.S. Pat. No. 7,438,653 describes another swing training device where a flexible rope is connected to a belt worn by a user. However, the position where the rope connects the belt is not fixed but instead a sliding connection, which effectively defeats the purpose of it because the sliding connection will significantly reduce the resistance from the rope. In addition, the fact that it does not provide a base is a disadvantage because fixing the rope on any object means the length of the rope needs to be constantly adjusted, and finding a fixture around a training site to tie the rope to is not always easy.

Therefore, there remains the need for a device and method for training an athlete in a sport that requires the hip rotation and lower body strength. There is also the need for the device being easy to set up in field practice and not hindering the normal swinging pattern.

SUMMARY OF THE INVENTION

The present invention provides a mobile training device, comprising: a upright frame, including at least one guide hole and at least one releasable clamp; a base connected to the upright frame, wherein the base including at least one front leg and at least one back leg, the back leg having at least one roller; an elastic rope releasably engaged with the clamp on the frame and extending through the guide hole, wherein a hook is attached to the end of the elastic rope; and a training belt adjustable in length, wherein the training belt has at least one ring to be engaged with the hook; wherein resistive force is variably provided by the elastic rope, and wherein the rope, by engaging through the guide hole with the ring on the training belt, is at an angle θ to the surface on which the user is standing such that the variable resistance has both a horizontal component and a vertical component.

In another aspect of the invention, it is provided a method for producing bi-directional resistive force, comprising the steps of: providing two elastic means with resistive force when stretched; creating a resistive force when the user rotates his torso by attaching the two elastic means to left and right side of the user's hip, wherein at least one of the two elastic means is at an angle θ to the surface on which the user is standing; rotating the user's torso; and thereby stretching the two elastic means to create bi-directional resistive force.

In another example of the present invention, a mobile training device for exercising against bi-directional resistance is provided. The device comprises: an upright frame having two clamps and a first guide hole and a second guide hole, wherein the first guide hole is vertically higher than the second guide hole; a base connected to the upright frame; a first and a second elastic rope each having a hook attached to one end thereof, the first and second ropes being releasably engaged with the clamps for variable resistance, and the first elastic rope passes through the first guide hole, and the second elastic rope passes through the second guide hole; and a training belt to be worn by a user, wherein the training belt having at least a first ring and at least a second ring to be engaged with the hooks attached to the first and second elastic rope, respectively, wherein when the training belt is worn by a user the first ring is located substantially opposite to the second ring; wherein the second rope in the section between the second guide hole and the second ring on the training belt is at an angle θ to the surface on which the user is standing.

In one embodiment, the upright frame is tilted away from the user to increase the stability of the device during use. The upright frame can be tilted at least 5 degree or more from vertical. In one embodiment, the first and second guide holes are vertically aligned while apart from each other. In another embodiment, the first and second guide holes are not vertically aligned.

In one embodiment, the frame and the base are separate and can be fastened together by, for example, screws. In another embodiment, the frame and the base can be integrated as one piece. In yet another embodiment, the frame and base can be coupled through a shaft such that the frame can be folded into the base.

In one embodiment, there can be more than two elastic ropes to provide additional resistance at similar or different angles. Corresponding numbers of the guide holes and claims can also be provided to accommodate the variation.

In one embodiment, another engaging means at or around the guide holes is provided so that the elastic ropes can pass through the rings on the training belt and circle back to hook on the engaging means, thus providing theoretically double resistance.

In one embodiment, the base has anti-slippery means at the bottom where it touches the ground such that the base can provided sufficient friction force to resist moving during use, regardless of the surface. The anti-slippery means can be, for example, traction pads.

In one embodiment, the base has for legs, two on the user side and two on the other side, for balance and stability purposes. However, the number and position of the legs may vary for the consideration of space, cost or weight, etc. In one embodiment, the back legs further have rollers attached for easily moving the device around.

In one embodiment, the training belt is adjustable in length and can be worn on different part of users' body. Preferably the training belt is worn at the hip because that is where most rotation is involved in a typical bat swing. However, the user can wear it on other parts of the body, for example waist, for reasons of comfort.

In one embodiment, the training belt has a first ring and a second ring located at opposite side of the training belt (as in the left and right side of a user) to be engaged with the first and second rope, respectively. In another embodiment, the training belt has a plurality of first rings and a plurality of second rings to account for different hip circumference.

The use of the word "a" or "an" when used in conjunction with the term "comprising" in the claims or the specification means one or more than one, unless the context dictates otherwise.

The terms "about" or "substantially" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

DESCRIPTION OF EMBODIMENTS OF THE INVENTION

Figure 1:
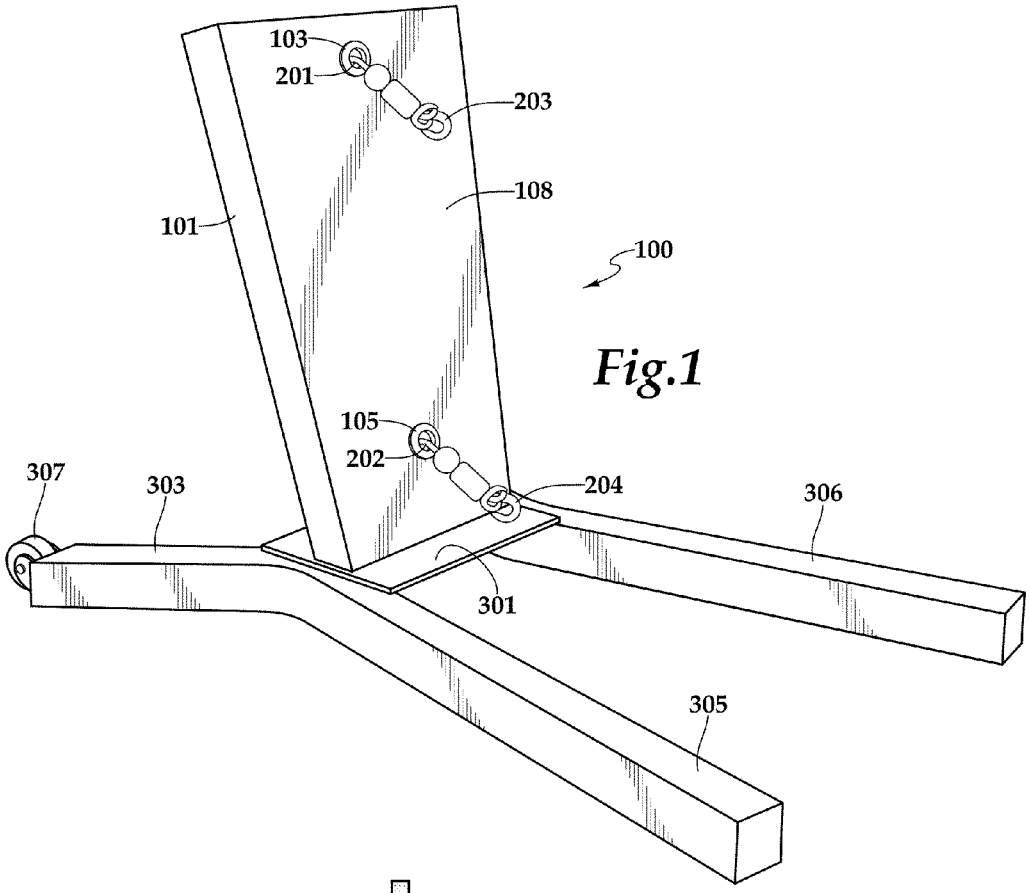
FIG. 1 is a schematic view of the training device of the present invention.
Figure 2A:
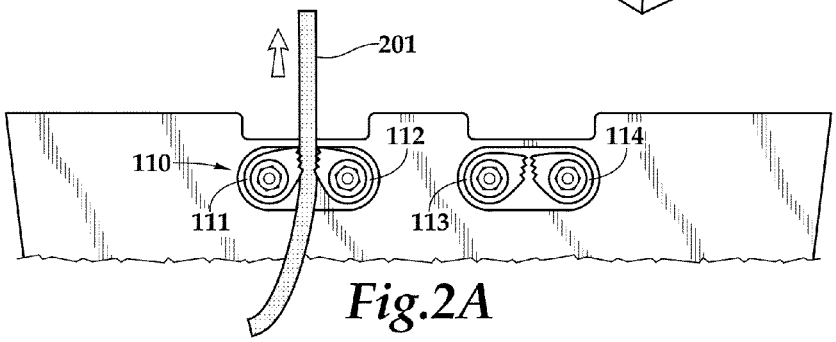
FIG. 2A is an illustration of the clamps as used in the present invention to uni-directionally adjust the length of the elastic rope.

FIG. 1 illustrates the mobile training device of the present invention. As shown in the figure, the training device 100 comprises an upright frame 101, and a base 301. The upright frame 101 has a front cover 108 on which locates a first guide hole 103 and a second guide hole 105. A first elastic rope 201, preferably stored as a reel inside the frame 101, extends from the first guide hole 103, and a second elastic rope 202 extends from the second guide hope 105. The elastic ropes are secured by clamps mounted on the frame 101, as seen in FIG. 2A. Both the first and second elastic ropes 201, 202 have a hook 203, 204 attached to the end of the ropes, respectively. The hook 203 is used to engage with a ring on a training belt (discussed later in FIG. 2B). But other equivalent mechanism may be used, such as a carabiner.

The upright frame 101 is attached to a base 301. The base 301 has two back legs 303 (only showing one in this figure) and two front legs 305, 306. The term "front" is used to describe the side closer to a user, and "back" is used to describe the side away from the user. The back legs 303 could preferably include rollers 307 for more easily moving around the device. The upright frame 101 and the base 301 are preferably made of sturdy, rigid material such that it will not bend or deform during use. The number of front and back legs and the arrangement thereof may vary depending on other designing considerations, as long as the device can be used in a stable and safe fashion.

The upright frame 101 can be straight vertical, but in the preferred configuration, the upright frame 101 is slightly tilted back away from the user because the this way the training device 100 has better stability when the user repeatedly pulls the elastic ropes during a training session, as the tilted frame 101 makes it more difficult to flip over.

The base 301 is preferably heavy enough also for maintaining the device immobile. The front legs 305, 306 extend both toward the user and outwardly for stability to prevent the whole device from flipping toward the user or sideways. The front legs are also angled to allow more standing space for the user. The bottom of the front legs may further have traction pads attached thereto to provide more stability. This features allows the device to be used on a wide range of surfaces, such as clay, lawn, concrete or even carpeted floor.

The upright frame 101 and the base 301 can be two separate pieces for easier handling and shipping, and later assembled by fastening the frame to the base with, for example, screws. Once fastened, the user can simply move the device by first lifting the front legs 305 and roll the device with the rollers 307.

The front legs 305, 306 do not necessarily have to be two separate legs. Other configuration may be possible as long as it can serve the functions of providing friction to hold the device still and prevent the device from flipping over during use. For example, the front leg can be a one-piece Z-shape structure. Other equivalent design should be apparent to persons skilled in the art. The same applies to the back legs 303, with the additional proviso that the roller 307 should be placed such that an user can move the device around with ease.

As shown in FIG. 2A, on or inside the upright frame 101, releasable clamps 111, 112, 113, 114 secure the elastic rope 201. Releasable clamps of the type used to restrain the lines of sail boats, in rock climbing, and the like are used to secure the ends of the elastic ropes. The releasable clamps are known as cam cleats when used with boats and as ascenders when used in rock climbing. The amount of resistance produced by a particular elastic rope is quickly and easily increased by pulling up on the rope while it is engaged in the clamp. The clamp will grip the rope after it is stretched. In other words, as used in the present invention, the elastic rope can only be releasbly pulled in the direction away from the user. When the user tries to pull it (or as discussed below when the user rotates his hip) the clamp will grip and stop the rope from further sliding from the clamp. Therefore, the only movement the user can get is from stretching the elastic rope, which then produce the resistive force.

When the user is trying to reduce the amount of resistance, the elastic rope can be disengaged from the clamp, and pushed back into the clamp when the desired resistive force (or desired length) is achieved. Although it is preferred that clamps of the type described are used to secure the ropes to the device and to adjust the amount of resistive force produced by the ropes, other means for securing the ropes to the device may also be used.

Although the clamps will be primarily relied upon in the preferred embodiment to adjust the resistance of the ropes, increasing the number of ropes can achieve the same effect, as discussed below.

The resistive force produced by the rope can be adjusted before a user begins a training session, or during the execution of a particular training. As a general rule, the longer the elastic rope is being stretched, the higher the resistive force. Preferably, before the user begins exercise, he can adjust the length of the ropes by changing his own relative distance from the mobile training device, such that the elastic ropes are tautly extending from the device to the training belt. This way, when the user rotates his hip, the elastic ropes are stretched and therefore exert resistive force.

Or alternatively, while a user is performing an exercise, the resistive force can be adjusted in minor amounts by the coach pulling up slightly on the rope when using an adjustable clamp. Because the way the clamps engage with the elastic rope, as shown in FIG. 2A, the elastic rope can only be pulled up as the arrow indicated, but not the opposite direction, because the clamp will bite and hold the rope in place. This ensures the easy adjustment of rope length thus the resistive force.

Greater increase in the resistive force can be accomplished by adjusting the length of the rope by pulling on the rope more. The clamp shortens the length of the elastic rope. Because of the ease of adjusting the amount of resistive force produced by the rope, a user can make the adjustments while performing the exercise. Or the resistive force can be easily doubled by pulling the elastic rope through the ring on the training belt and circling back to the ring on the upright frame. The means for adjusting the rope also allows easily lessening the amount of resistive force while performing an exercise. Thus, a user can continually increase the resistive force to work harder during an exercise routine or lessen the resistive force fatiguing without stopping the exercise movement.

Figure 2B:
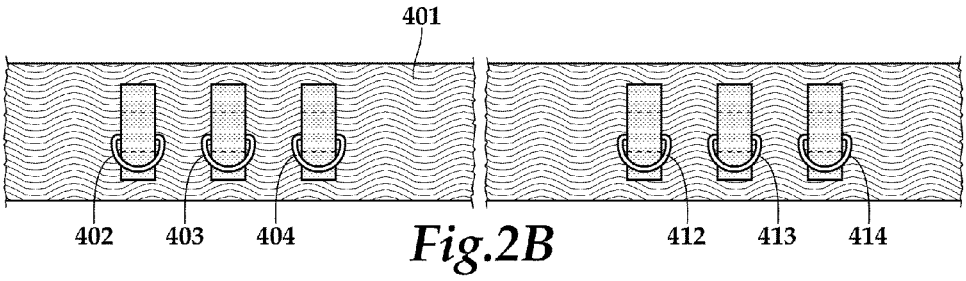
FIG. 2B is a schematic view of the training belt of the present invention.

Referring to FIG. 2B, which shows the training belt 401 of the present invention. The training belt 401 has at least one first rings 402, 403, 404 and at least one second rings 412, 413, 414. In a preferred embodiment, there are three or more first rings and three of more second rings on the training belt 401. The length of the training belt 401 can be adjusted through a buckle (not shown) so as to tightly fit on a user's body part, preferably the hip. The first rings 402, 403, 404 and second rings 412, 413, 414 are positioned such that when a user wears the training belt around his hip the first rings are at one side (for example, left side) of the body and the second rings are at the other side (right side) of the body. For a right-hander, that means the first rings are away from the training device, and the second rings are closer to the training device. The hook 203 of the first elastic rope 201 engages with one of the first rings 402, 403, 404 and the hook 204 of the second elastic rope 202 engages with one of the second rings 412, 413, 414. The plurality of rings makes it easy for users of different waist circumference to use the same belt without having to adjust the position. In one embodiment the user can engage the hooks with the one ring such that the resistive force can be exerted throughout the exercise. In another embodiment the user can engage the hooks with the one ring such that the resistive force is exerted for only a portion of the exercise.

In a preferred embodiment, the hook and the rings are color-matched such that a user can easily connect the right hook with the rings on the correct side of the body.

In another preferred embodiment, a tension-measuring tool (not shown), for example a hanging weighing scale, is provided on each of the elastic ropes 201, 202 so that the user can determine how much resistance to be training against.

Figure 3:
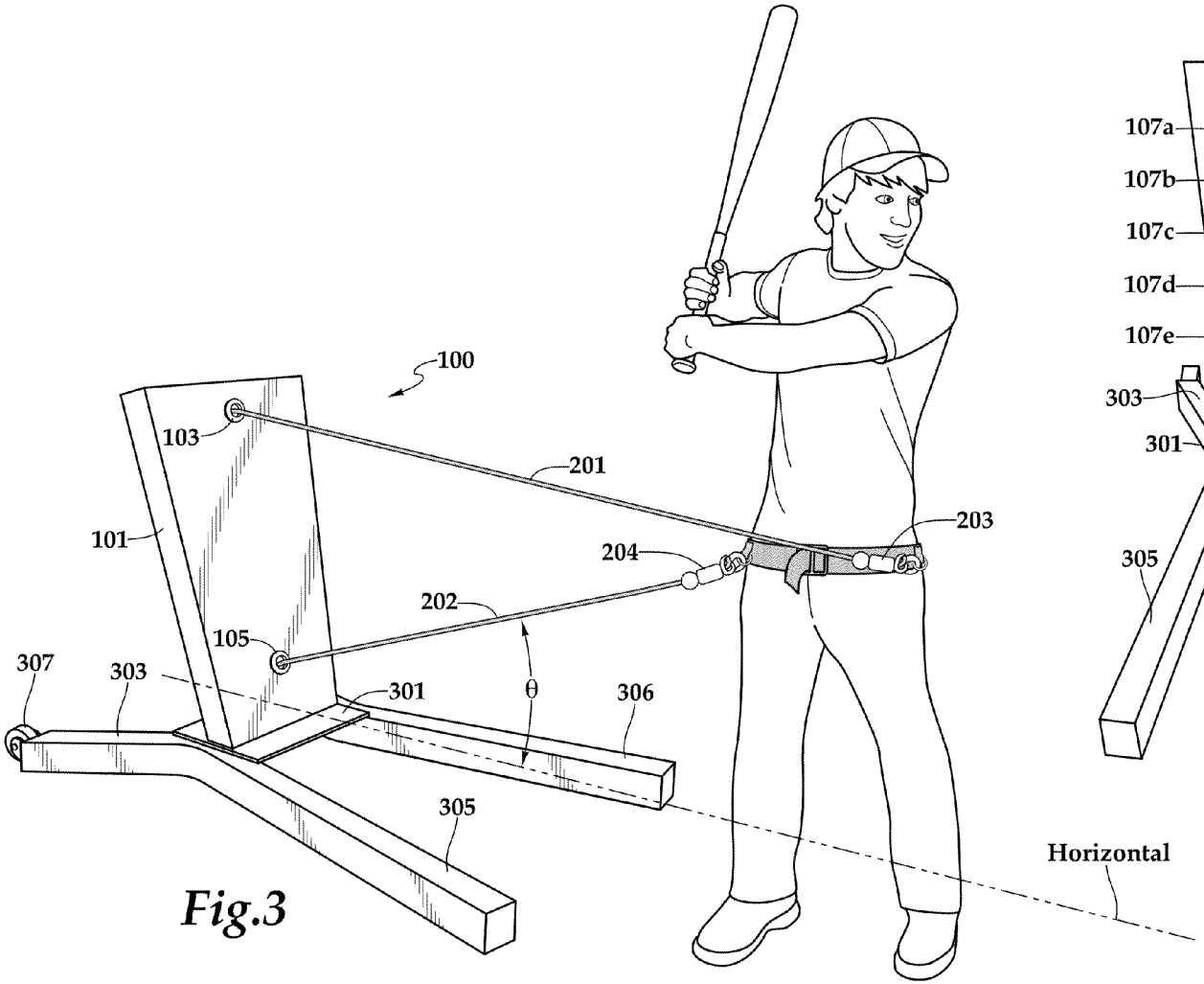
FIG. 3 is a schematic view showing a batter using the training device of the present invention in a ready stance.

Referring to FIG. 3, in which a baseball batter is using the training device of the present invention in a preparation stance. The batter in this example is a right hander, however, as illustrated further below, the device of the present invention is equally efficient in training a left hander. At this point, the first elastic rope 201 is connected to the first ring located at the left side (from the batter's perspective) of the batter's hip. To properly exert the resistive force, the first elastic rope should pass in front of the batter instead of behind, because this way when the batter rotates his body the first elastic rope 201 is extended. If the first elastic rope runs behind the body, there will not be any tension when the batter rotates his hip. The second elastic rope 202 is connected to the second ring located at the right side of the batter's hip. Preferably at this point the length of the first and second elastic ropes are adjusted such that some degree of tension of the ropes is maintained at the preparation stance. In other words, the ropes are preferably adjusted such that they are tautly extending from the guide hole to the rings, not loosely hanging.

In this setting, the second elastic rope 202 is at an angle θ to the surface on which the user is standing, whereas the first elastic rope is substantially parallel to the ground. As explained below, this bi-directional design brings unprecedented results to the training process.

If the user is a left-hander, the user can simply reverse the configuration discussed above. For example, the hook 204 of the second elastic rope 202 can now engage with the first rings 402, 403, 404 on the training belt 401, the first rings now closer to the training device 100 for a left-hander. Similarly, the hook 203 of the first elastic rope 201 can now run in front of the user to engage with the second rings 412, 413, 414, which are on the user's right side and away from the mobile training device 100. Therefore, a left-hander can also use the mobile training device of the present invention.

Figure 5:
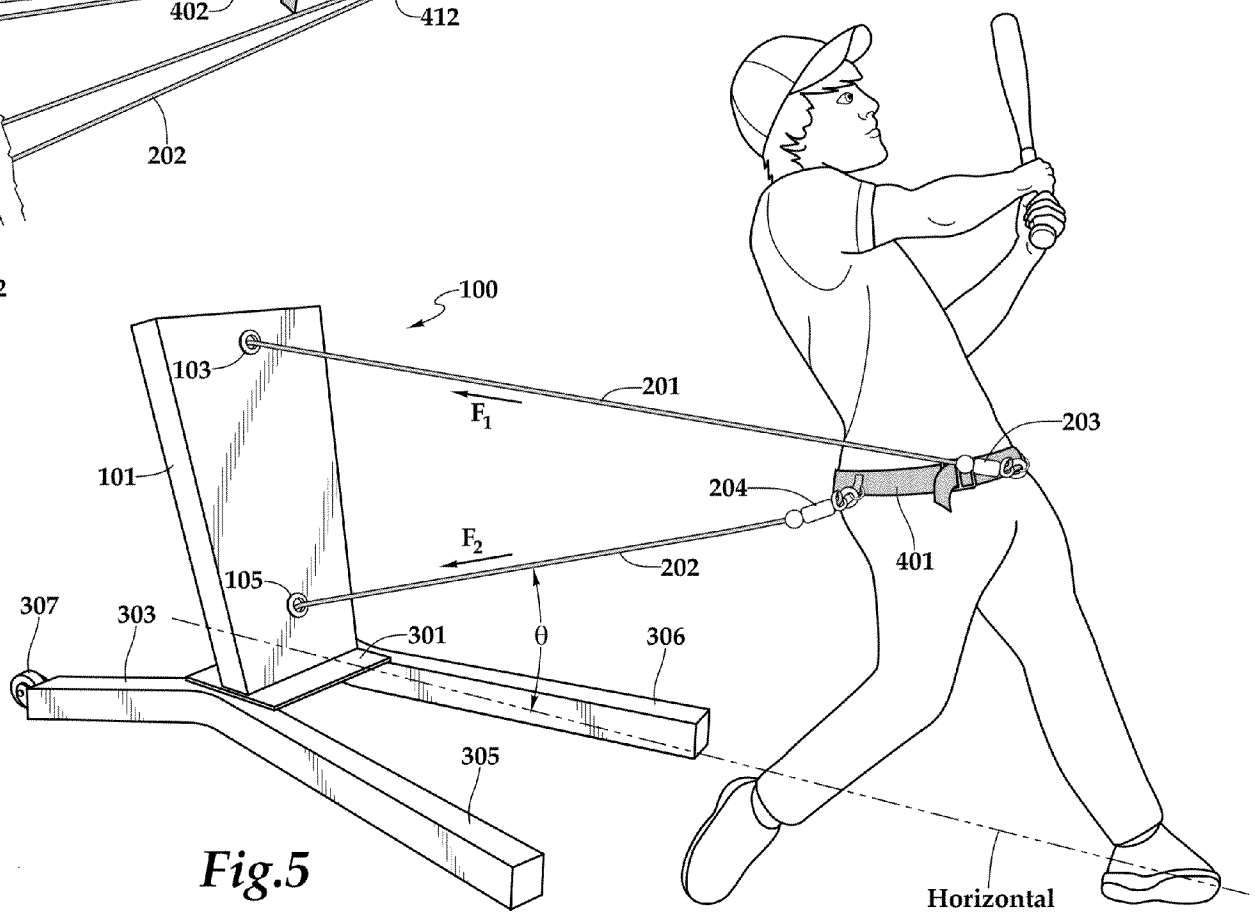
FIG. 5 is a schematic view showing a batter using the training device of the present invention in a swing stance.

Referring now to FIG. 5, which shows that the batter is completing the swing motion. As the batter's hip rotate during the swing, the first elastic rope 201 is extended and exerts a resistive force F1, as the second elastic rope 202 is also extended and exerts a resistive force F2. As mentioned above, the first elastic rope 201 is substantially parallel to the horizontal, and therefore F1 has mostly the X component. The second elastic rope 202 is at an angle θ to the horizontal surface on which the user is standing, which means F2 will have a F2×sin θ as the Y component and a F2×cos θ as the X component. In other words, the batter will exercise against (F1+F2 cos θ) as the horizontal resistive force, and F2 sin θ as the vertical resistive force when swinging. The horizontal resistive force is what the batter will be exercising against with the hip rotation, whereas the vertical resistive is what the batter will be exercising against with the lower body.

The vertical component is even more important when the device is used to train a tennis player. The prevailing view for a tennis forehand is that the player has to both lean in on the ball and push upward, while at the same time rotate the hip. In this instance the force F1 provides the rotational resistance, whereas the vertical component of force F2 provides the upward resistance for effective training at once. The same is true for a tennis serve where the player is required to leap upward while rotating the hip.

Figure 4:
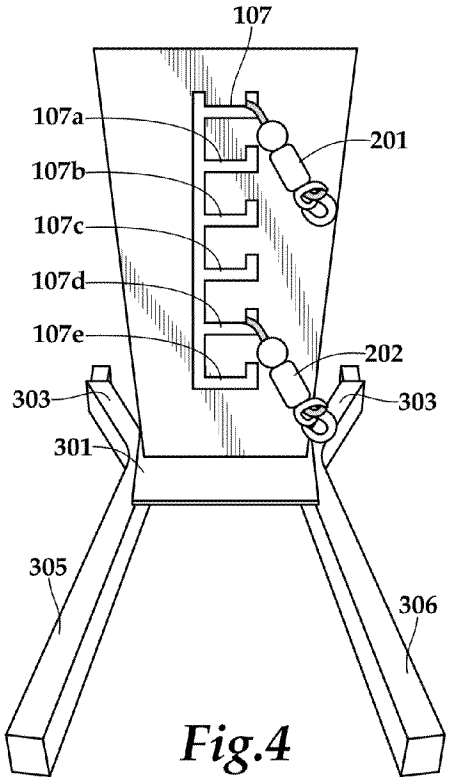
FIG. 4 is a schematic view showing a different configuration of the guide holes.

Referring now to FIG. 4, which illustrates a different configuration of the guide hole. The purpose for such configuration is that the angle θ between the second elastic rope 202 and the ground can be adjusted such that the vertical component of F2 sin θ can be easily changed accordingly. In this figure, the guide opening 107 has fishbone-like shape, where each branch 107A, 107B, 107C is located at different elevation, and therefore the user can easily change the starting height of the second elastic rope 202, or even the first elastic rope 201.

Figure 6:
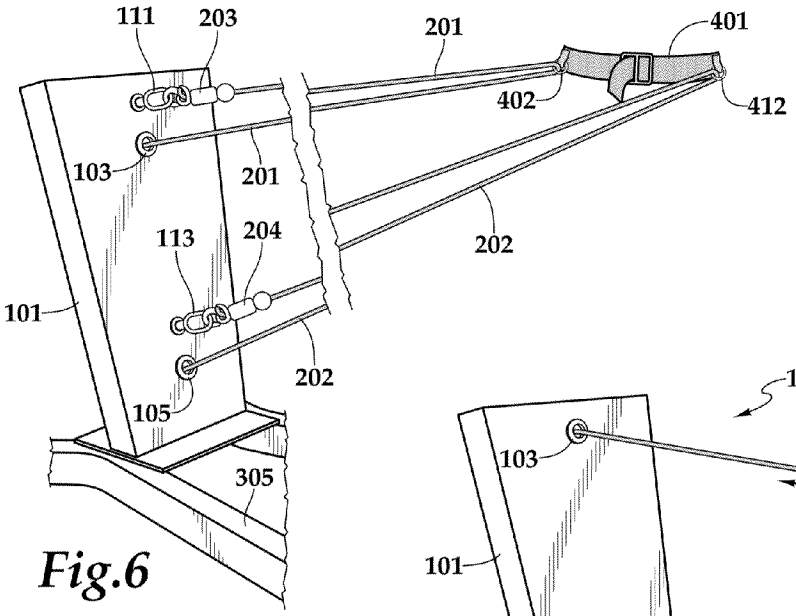
FIG. 6 is a schematic view showing a variation of an embodiment of the present invention.

Referring now to FIG. 6, which shows another variation of the device of the present invention to easily double the resistive force. In this figure, a first ring 111 is provided on the upright frame 101 near the first guide hole 103, and a second ring 113 is also provided on the upright frame 101 near the second guide opening 105. The second elastic rope 202 exiting the second guide hole 105 passes through the second ring 412 on the training belt 401, then returns near the second guide hole 105, where the second hook 204 engages the second ring 113. Because now there are effectively two elastic ropes 202 between the second guide hole 105/second ring 113 and the second ring 412 of the training belt, the resistive force in this direction is doubled. The same applies to the first rope 201 to easily double the resistive force.

Figure 7A:
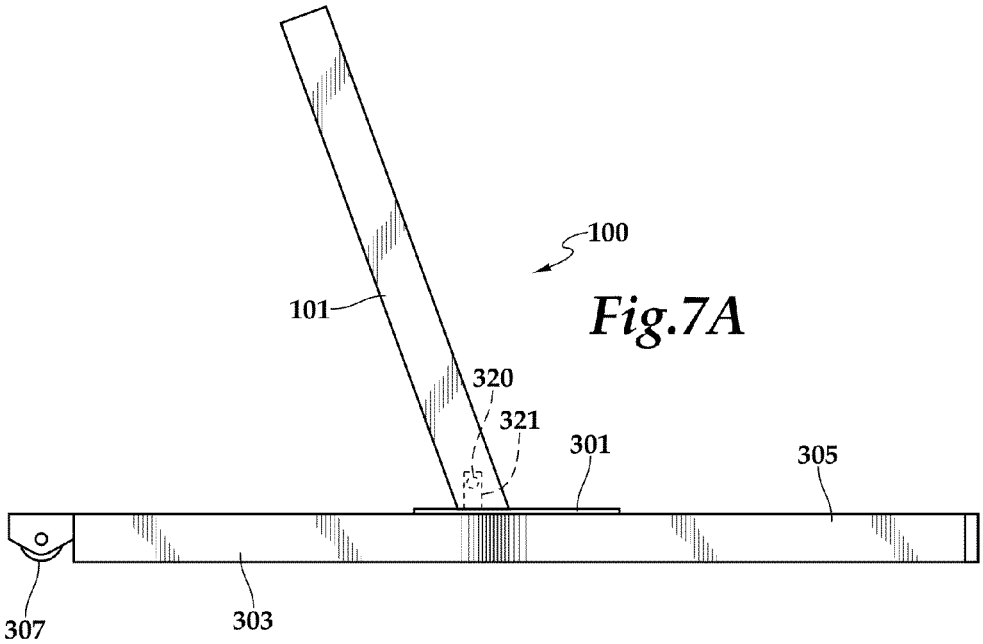
FIG. 7 is a schematic view showing another variation of an embodiment of the present invention.
Figure 7B:
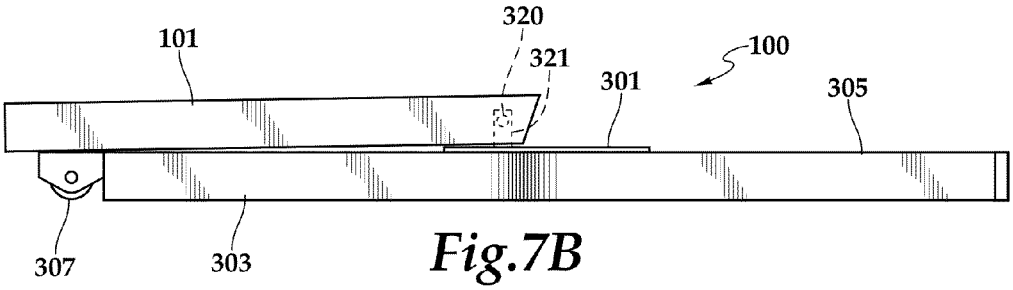
Figure 7C:
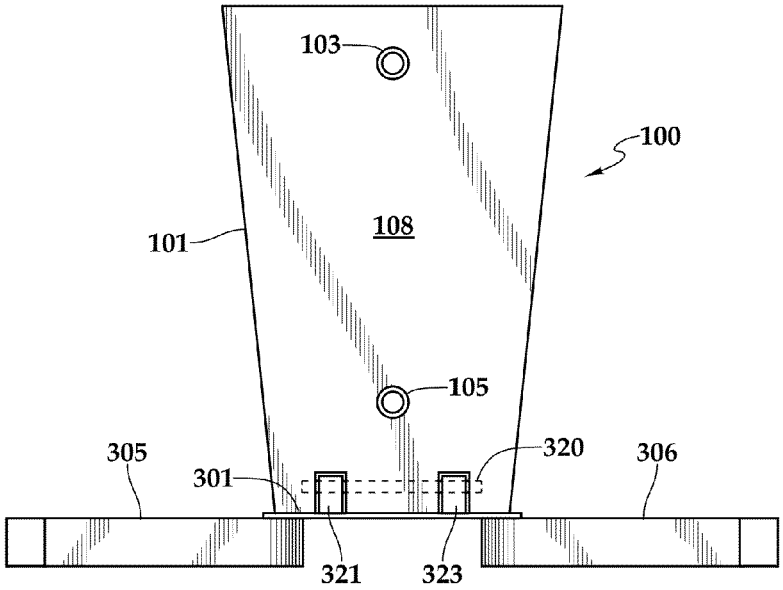

Referring now to FIGS. 7A-C, which shows another variation of the training device of the present invention. FIGS. 7A-B are the side perspective, while FIG. 7C shows the front perspective. In FIG. 7A, the upright frame 101 is pivotally coupled to the base 301 with a shaft 320 that extends through openings in shaft mountings 321 and 323 sized to receive the diameter of the shaft 320. The shaft mountings 321 and 323 are fixed to base 301. Therefore, the upright frame 101 can rotate about the shaft 320 down to the substantially flat configuration shown in FIG. 7B for easier transportation and/or shipping and handling. As person skilled in the art can understand, the shaft 320 and arm 320 can be designed with a stopper (not shown) so that the upright right frame 101 can only rotate between the positions shown in FIGS. 7A and 7B, and preferably releasably retained at these positions. FIG. 7C shows the front perspective of the training device with the shaft 320 and two arms 321, 323 holding the shaft. It is to be noted that the number of the shaft and arms are not limited, as long as the training device can be rotated in a smooth and safe fashion.

The other feature of the present invention is stabilizing the batter's body during training. By keeping both the first and second elastic ropes aligned on the same vertical plane, the batter can maintain the center of the body steady while transferring his body weight from the back leg to the front leg. If there is only one elastic rope, or if the two elastic ropes are not vertically aligned, it will be more difficult for the batter to maintain the center of the body stable. This is important because a batter needs to keep his eyes on the incoming baseball to gauge the speed and possible route of it when swinging, and a steady body is a key element to doing that. The vertically aligned first and second guide holes keep the batter's centerline steady during the swing.

The mobile training device of the present invention can also be used for training a golf swing. A typical golf swing also requires the transfer of weight from the back foot and the rotation of the hip. The mobility of the present invention gives the user the possibility to do the training at different locations, such as a driving range.

The mobile training device of the present invention can provide bi-directional resistive force for a trainee to exercise both the core rotational strength and the upward lower body strength simultaneously. The mobile feature also allows the training device to be easily transported and set up on various surfaces and training purposes. The resistive force can also be easily adjusted for different training regimen.

What is claimed is:

1. A mobile training device, comprising:

a) a upright frame, including at least one guide opening located on a front cover of the frame;

b) at least one releasable clamp fixed to the upright frame;

c) a base connected to the upright frame, wherein the base including at least one front leg and at least one back leg, the back leg having at least one roller;

d) at least an elastic rope releasably engaged with the clamp and extending from the guide hole, wherein a hook is attached to the end of the elastic rope; and e) a training belt adjustable in length, wherein the training belt has at least one ring to be engaged with the hook;

wherein resistive force is variably provided by the elastic rope, and wherein the elastic rope, by engaging through the guide hole with the ring on the training belt worn by a user, is at an angle θ to the surface on which the user is standing such that the variable resistance has both a horizontal component and a vertical component.

2. The mobile training device of claim 1, wherein the base has two front legs and two back legs, and each of the back legs has a roller.

3. The mobile training device of claim 1, wherein the training belt has at least one first ring and at least one second ring, wherein the first ring and the second ring are spaced apart on the training belt.

4. The mobile training device of claim 3, wherein the upright frame has a first guide opening and a second guide opening, and the first guide opening is vertically higher than the second guide opening.

5. The mobile training device of claim 4, wherein the mobile training device comprising a first elastic rope having a first hook and a second elastic rope having a second hook, and wherein the first hook being engaged to the first ring and the second hook being engaged to the second ring on the training belt.

6. The mobile training device of claim 4, wherein the upright frame further comprising a first ring near the first guide opening and a second ring near the second guide opening.

7. The mobile training device of claim 1, further comprising a tension-measuring means for measuring the tension of the elastic rope.

8. The mobile training device of claim 1, wherein the upright frame can be folded into the base.

9. The mobile training device of claim 1, wherein the upright frame is tilted away from the user.

10. The mobile training device of claim 1, wherein the upright frame is pivotally coupled to the base through a shaft and an arm.

11. The mobile training device of claim 1, wherein the clamp engages with the elastic rope such that the elastic rope can only be releasbly pulled in the direction away from the user.

12. A mobile training device, comprising:

a) a upright frame, including at least one guide opening located on a front cover and at least one releasable clamp;

b) a base pivotally coupled with the upright frame through an arm fixed on said base and a shaft, wherein the base including at least one front leg and at least one back leg, the back leg having at least one roller;

c) at least an elastic rope releasably engaged with the clamp and existing from the guide hole, wherein a hook is attached to the end of the elastic rope; and d) a training belt adjustable in length, wherein the training belt has at least one ring to be engaged with the hook;

wherein resistive force is variably provided by the elastic rope, and wherein the rope, by engaging through the guide hole with the ring on the training belt worn by a user, is at an angle θ to the surface on which the user is standing such that the variable resistance has both a horizontal component and a vertical component.

* * * * *